US005303903A

United States Patent [19]

Butler et al.

[11] Patent Number: 5,303,903

[45] Date of Patent: Apr. 19, 1994

[54] AIR COOLED MOLTEN METAL PUMP FRAME

[75] Inventors: Warren G. Butler, Rogersville; Henry C. Perkins; Dale C. Hornsby, both of Florence, all of Ala.

[73] Assignee: Reynolds Metals Company, Richmond, Va.

[21] Appl. No.: 991,624

[22] Filed: Dec. 16, 1992

[51] Int. Cl.[5] ..... C21C 5/42

[52] U.S. Cl. ..... 266/239; 266/287

[58] Field of Search ..... 266/287, 236, 239; 432/234

[56] References Cited

U.S. PATENT DOCUMENTS

| | | | |
|---|---|---|---|
| 669,466 | 5/1901 | McRae et al. | 266/239 |
| 2,602,615 | 7/1952 | Maynard et al. | 248/676 |
| 2,707,628 | 5/1955 | Munford | 266/274 |
| 3,058,432 | 10/1962 | Lamb | 266/239 |
| 3,123,015 | 3/1964 | Linklater | 266/239 |
| 3,652,073 | 3/1972 | Lewis | 266/239 |
| 4,174,190 | 11/1979 | Craig et al. | 417/50 |
| 4,629,422 | 12/1986 | Bricmont | 432/234 |
| 4,909,981 | 3/1990 | Garabedian | 376/293 |

*Primary Examiner*—Scott Kastler

*Attorney, Agent, or Firm*—Alan M. Biddison

[57] ABSTRACT

An air cooled molten metal pump frame includes a base structure and molten metal pump supporting structure comprising tubular members to facilitate flow of cooling air therethrough. The cooling air flowing through the molten metal pump frame provides cooling to the pump frame to minimize distortion and deformation due to the high temperatures caused by an adjacent molten metal bath. The cooling air flowing through the pump frame can also be directed to the molten metal pump to cool pump components. The tubular frame also facilitates simple and effective connection between a source of electrical power and the molten metal pump while shielding the electrical wiring from heat damage due to the proximity of the molten metal bath. The molten metal pump frame is particularly adapted for supporting molten metal pumps used in aluminum reclamation furnaces.

14 Claims, 2 Drawing Sheets

AIR COOLED MOLTEN METAL PUMP FRAME

FIELD OF INVENTION

The invention relates to an air cooled molten metal pump frame, and in particular, to a pump frame having tubular frame members housing electrical supply wiring and flow passageways for cooling of the pump frame and the molten metal pump.

BACKGROUND ART

In the reclamation of aluminum, it is known to use molten metal pumps in reclamation furnaces. In one particular use, sidewell melters with submerged arches utilize molten metal pumps to circulate and pump the molten aluminum from one area of the furnace to another. These molten metal pumps direct molten alumi7 num to hotter areas of the furnace to improve temperature uniformity.

Typically, and when using sidewell melters, the molten metal pumps are supported above a 1300°-1400° F. aluminum bath by a support framework made of two inch I-beams. However, these support frames are susceptible to excessive warping and damage due to the intense heat generated by the open surface of the molten aluminum bath.

In view of the disadvantages associated with prior art molten metal pump support frames, a need has developed for an improved molten metal pump frame. In response to this need, the present invention provides an air cooled molten metal pump frame which permits supporting the molten metal pump over an aluminum bath while maintaining the integrity and longevity of the pump frame.

In the prior art, it is known to provide cooled support rails or frame apparatus for workpieces in furnaces. U.S. Pat. No. 2,707,628 to Munford discloses water-cooled support rails for a high temperature heating chamber such as a billet heating furnace U.S. Pat. No. 4,629,422 to Bricmont also discloses a re-heat furnace having spaced-apart skid frames for supporting work pieces. The spaced-apart rails include cord members and tubular web members which are supplied with coolant to prevent overheating.

However, neither of these references teach or fairly suggest a molten metal pump frame permitting air cooling of the pump frame to minimize or prevent heat distortion or damage due to an open surface molten metal bath such as an aluminum reclamation bath.

SUMMARY OF THE INVENTION

It is accordingly a first object of the present invention to provide an improved molten metal pump frame resistant to heat deformation and distortion.

Another object of the present invention is to provide a molten metal pump frame adapted to be air or fluid cooled to minimize or reduce damage to the pump frame due to high temperatures in its environment of use.

It is a further object of the present invention to provide a molten metal pump frame which facilitates providing electric power to a molten metal pump when suspended over a molten metal bath.

A still further object of the present invention is to provide a molten metal pump frame which provides cooling fluid to cool the molten metal pump components such as the pump motor.

Other objects and advantages of the present invention will become apparent as the description thereof precedes.

In satisfaction of the foregoing objects and advantages, there is provided a molten metal pump frame comprising a base frame and a molten metal pump supporting structure integrally attached to the base frame for supporting a molten metal pump. The base frame further comprises a first passageway therethrough, a cooling fluid inlet for receiving a source of forced cooling fluid, the inlet being in communication with the first passageway, and a means for connecting a source of electrical power to the molten metal pump. The molten metal pump supporting structure includes a second passageway and a cooling fluid outlet in communication with the second passageway to facilitate flow of cooling fluid through the molten metal pump frame, the second passageway being in communication with the first passageway.

The base frame may also include another cooling fluid outlet to provide flow of cooling fluid to components of the molten metal pump.

The cooling fluid inlets and outlets may include couplings to facilitate attachment to a source of cooling fluid such as air. The means for connecting a source of electrical power may include electrical connectors and wiring arranged in the base frame for shielding and cooling purposes.

BRIEF DESCRIPTION OF THE DRAWINGS

Reference is now made to the drawings accompanying the invention wherein.

DESCRIPTION OF THE PREFERRED EMBODIMENTS

The inventive air cooled molten metal pump frame provides advantages over prior art devices. First, the capability of providing a cooling fluid flowing through the pump frame members increases the pump frame service life over prior art frames by reducing frame deterioration as a result of the high temperature environment of use.

The air cooled molten metal pump frame functions in a dual manner by cooling not only the pump frame members by also components of the molten metal pump such as the motor thereof. The frame configuration facilitates simple connection for cooling the molten metal pump components as well as support of the molten metal pump over a molten metal bath such as an aluminum reclamation bath.

The air cooled molten metal pump frame also facilitates providing a simple and effective means to connect the molten metal pump to a source of electric power. The air cooling aspect of the inventive pump frame permits shielding and cooling electric wiring within the frame members to minimize adverse effects from high temperatures caused by close proximity to the molten metal bath.

Figure 1:
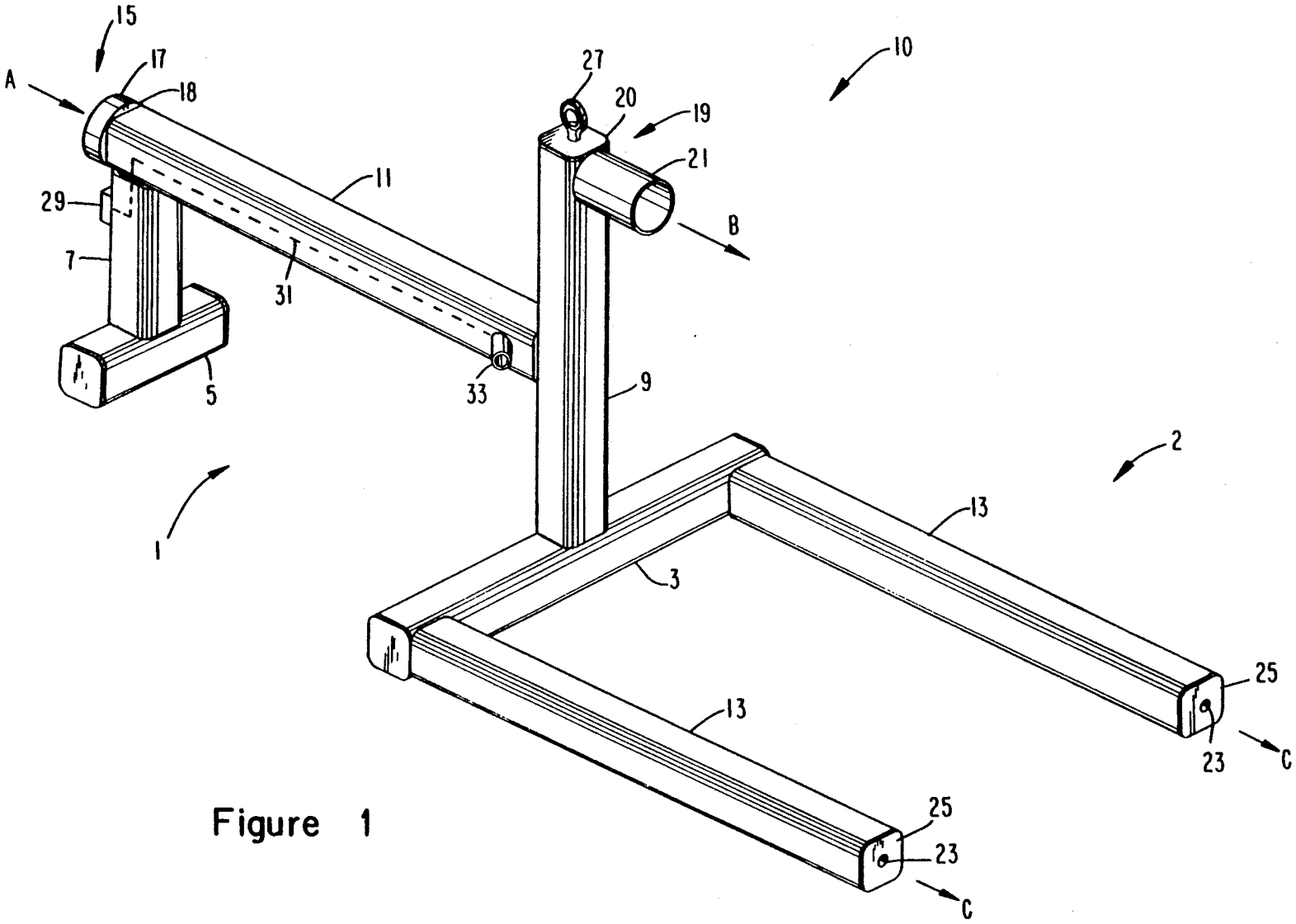
FIG. 1 shows a perspective view of one embodiment of the inventive molten metal pump frame.

With reference now to FIG. 1, a first embodiment of the air cooled molten metal pump frame is generally designated by the reference numeral 10 and includes a base structure designated by the reference numeral 1 and a pump supporting structure designated by the reference numeral 2. The base structure 1 includes a pair of base members 3 and 5. Extending upwardly from the base member 5 is a leg 7 with a leg 9 extending upwardly from the base member 3. A cross member 11 interconnects the legs 7 and 9.

The pump supporting structure 2 includes a pair of pump support members 13 extending from the opposing ends of the base member 3. As will be described hereinafter, the pump support members 13 are spaced apart to provide support for the molten metal pump, a portion of which being disposed between the pump support members 13. The base member 5 and support members 13 are designed to rest on a surface adjacent a molten metal bath. For example, the pump frame can rest on the walls of a molten metal furnace 57, see FIG. 2. The T-shaped configuration of the legs 7 and 9 and base members 5 and 3 with support members 13 function to support a molten metal pump submerged in a molten metal bath.

Each of the cross member 11, leg 9, base member 3 and pump support members 13 are tubular in design so as to provide an internal passageway (not illustrated) for the flow of a cooling fluid such as air through the pump frame. As will be described hereinafter, the internal passages also house electrical wiring to connect a source of electrical power to the molten metal pump components.

In a preferred embodiment, the various frame members are constructed of four inch square tubing welded together. The internal passageway of this tubing provides an adequate flow of cooling air to cool the pump frame during use. To facilitate manufacture, the leg 7 and base member 5 may also be tubular in design. It should also be understood that each of the frame members includes the appropriate opening to permit flow of cooling fluid therethrough. For example, the leg 9 would include an opening to align with the open end of the cross member 11 to facilitate flow of cooling through the cross member 11 into the leg 9. Likewise, the base member 3 includes the appropriate openings to permit flow of cooling air to the pump support members 13.

Still with reference to FIG. 1, the cross member 11 has an air inlet designated by the reference numeral 15 at one end thereof. This air inlet provides connection to a source of cooling air (not shown) to both cool the pump frame and pump components. The air inlet 15 includes a coupling 17 for a flexible conduit (not shown) to facilitate attachment to a source of forced air. In one embodiment, the coupling 17 may be a collar welded to the end 18 of the cross member 11. The collar surrounds an opening in the end 18 of the cross member 11 to permit the forced air to flow through the pump frame. The collar may be used with a cam lock or other quick connect fitting. The collar acts as a base for the quick connect fitting (not shown) which is then fastened to a flexible conduit such as a steel reinforced hose or the like.

The leg 9 includes an air outlet 19. The air outlet 19 is configured in a similar manner as the air inlet 15 with a flexible coupling 21 slip fit over a collar provided on the end 20 of the leg 9. As will described hereinafter, the flexible coupling 21 can be connected to an air inlet on the molten metal pump to provide cooling air for pump components such as the pump motor. Of course, other types of connections or couplings may be utilized for the inlet 15 and outlet 19 such as rigid fittings or the like.

The pump support members 13 include outlets designated by the reference numeral 23 to permit a continuous flow of cooling air through the pump frame. Although the outlets are shown as orifices in the end plates 25 of the pump support members 13, multiple openings or differently sized openings may be utilized for air outlet purposes.

The arrow designated by the letter A indicates the flow of cooling air or other cooling fluid to the molten metal pump frame 10. The arrow designated as letter B indicates the cooling air outlet to the molten metal pump with the arrows designated by the letter C representing cooling air outlet from the molten metal pump frame.

The pump frame 10 also includes an eye hook 27 which permits lifting the molten metal pump frame by a crane or the like.

As discussed above, the inventive molten pump frame also facilitates connecting a source of electric power to the molten metal pump. With reference again to FIG. 1, an electrical connection 29 is provided on the exterior of the leg 7. In a preferred embodiment, the electrical connection is a male 4-pronged welding receptacle. Using this type of receptacle simplifies connecting to a source of electric power. Of course, other known types of electrical connections may be utilized.

From the electrical connection 29, electrical wiring designated by the reference numeral 31 runs through the internal passages of the leg 7 and cross member 11 to the electrical wiring outlet 33. As will described hereinafter, the electrical wiring extends to the molten metal pump for powering the pump as well as control elements such as temperature sensors and the like. Housing the electrical power supply lines within the pump frame cools and shields the supply lines from damage and deterioration due to the excessive temperatures generated by the open surface molten metal bath.

Figure 2:
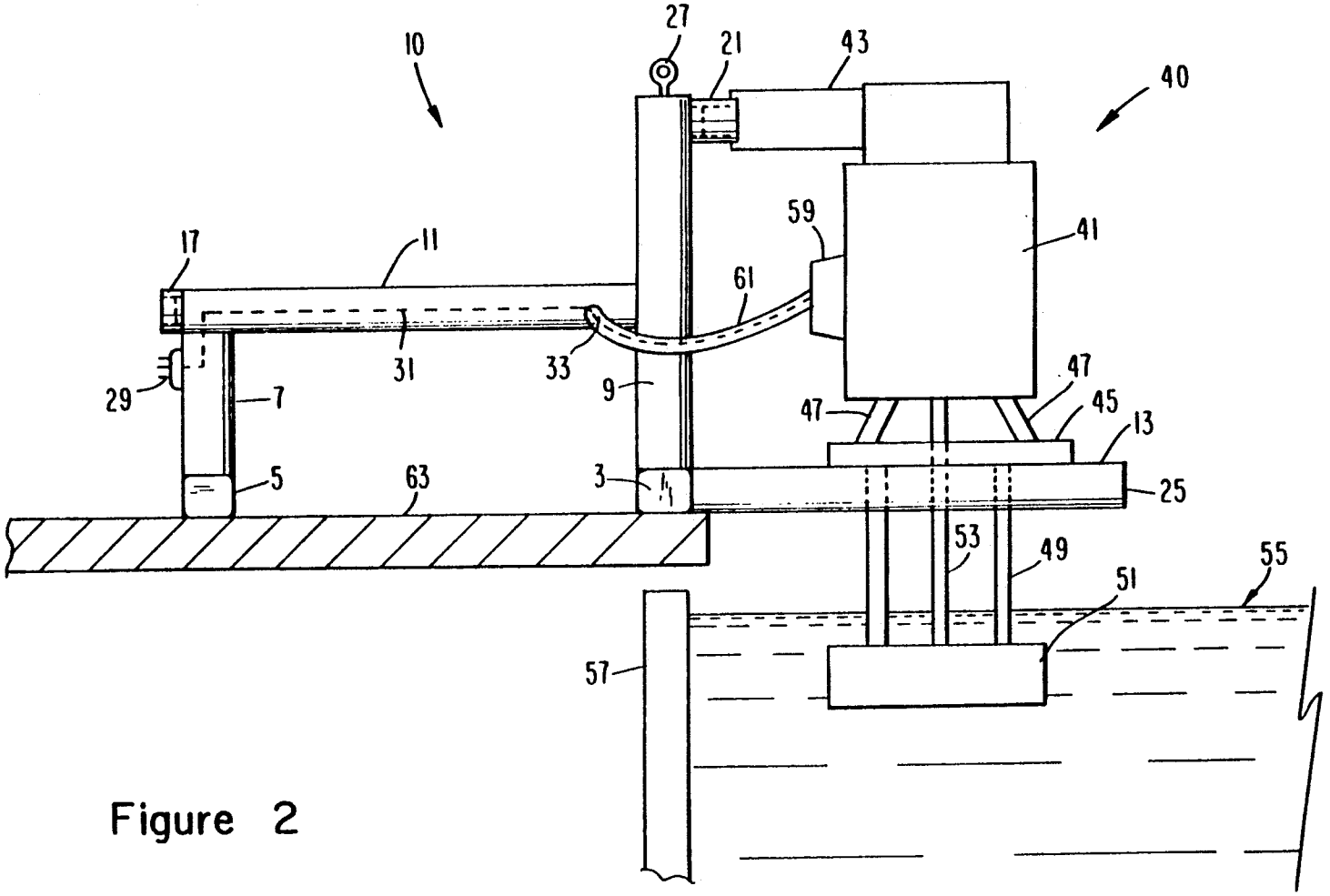
FIG. 2 shows a side view of the molten metal pump frame depicted in FIG. 1 in an exemplary use.

With reference now to FIG. 2, an exemplary use of the inventive molten metal pump frame is shown wherein the molten metal pump frame supports the molten metal pump 40. The molten metal pump 40 includes a motor 41 and cooling air connection 43. The cooling air connection 43 may be coupled to the flexible coupling 21 of the molten metal pump frame in any known manner. For example, a hose clamp may be utilized to secure the flexible coupling 21 within the cooling air connection 43.

The motor 41 rests on a motor support frame 45 via legs 47. The motor support frame 45 rests on the pump support members 13. If desired, the motor support frame 45 may be fastened to the motor support members 13 in any conventional manner, for example, screws, bolts or the like. Extending below the motor support frame 45 are legs 49 which support the base 51 which extends below the surface of a molten bath 55 in a furnace 57. The base 51 houses an impeller (not shown) which is driven by the motor 41 via the impeller shaft 53. The base 51 includes inlets on the top surface thereof and a discharge outlet on the side surface thereof to direct the flow of pumped molten metal toward hotter portions of the furnace 57.

The motor 51 also includes an electrical connection box 59. A shielded conduit 61 provides interconnection between the electrical components of the pump 40 and the electrical wiring outlet 33 of the molten metal pump frame. The electrical wiring may be hard wired to the pump 40 or include electrical connectors to facilitate a removable connection to the pump 40. The shielded conduit may be any known type capable of resisting high temperatures, for example, a flexible steel conduit known as SEAL-TIGHT. Preferably, the shielded conduit includes a passageway therethrough to permit flow of cooling air through the conduit to further cool electrical wiring therein.

Although the molten metal pump frame 10 is shown in FIG. 2 being supported by furnace 57, the molten metal pump frame may be supported on various surfaces to position the molten metal pump base 51 below the surface of a molten metal bath. For example, the base members 3 and 5 may be used to support the molten metal pump in a cantilevered fashion.

It should be understood that the molten metal pump disclosed in FIG. 2 is well known in the art and not considered an aspect of the present invention.

Although the molten metal pump frame is disclosed particularly for use in aluminum reclamation furnaces, the molten metal pump frame is adaptable for supporting a molten metal pump over other types of molten metal baths including both ferrous and nonferrous types.

As such, an invention has been disclosed in terms of preferred embodiments thereof which fulfill each and every one of the objects of the present invention as set forth hereinabove and provides a new and improved air cooled molten metal pump frame.

Of course various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A molten metal pump frame comprising:

a) a base frame; and b) a molten metal pump supporting structure integrally attached to said base frame for supporting a molten metal pump, wherein said base frame and said molten metal pump supporting structure are sized to form a portable molten metal pump frame to facilitate positioning over a molten metal bath;

c) said base frame further comprising:

i) a first passageway therethrough;

ii) a cooling fluid inlet for receiving a source of forced cooling fluid, said inlet being in communication with said first passageway;

iii) means for connecting a source of electrical power to said molten metal pump;

iv) a first cooling fluid outlet to provide flow of cooling fluid to components of said molten metal pump, said first cooling fluid outlet being in communication with said first passageway;

d) said molten metal pump supporting structure further comprising a second passageway and a second cooling fluid outlet in communication with said second passageway to facilitate flow of cooling fluid through said molten metal pump frame, said second passageway being in communication with said first passageway.

2. The frame of claim 1 wherein said cooling fluid inlet includes a means for coupling to said source of cooling fluid.

3. The frame of claim 1 wherein said cooling fluid inlet includes a first means for coupling to said source of cooling fluid and said second cooling fluid outlet includes a second means for coupling to a component of said molten metal pump.

4. The frame of claim 1 wherein said means for connecting a source of electrical power further comprises:

i) an electrical connection adapted to connect to a source of electrical power, said electrical connection mounted on said base structure; and ii) electrical wiring extending from said electrical connection and through at least a portion of said first passageway to an electrical wiring outlet mounted on said base structure, said electrical wiring for connection to electrically powered components of said molten metal pump.

5. The frame of claim 4 further including a shielded conduit for housing said electrical wiring extending outwardly from said electrical wiring outlet to said electrically powered components.

6. The frame of claim 5 wherein said shielded conduit includes a third passageway therethrough to permit said cooling fluid to flow therethrough.

7. The frame of claim 1 wherein said molten metal pump supporting structure further comprises a pair of spaced apart elongated members, one end of each elongated member attached to said base frame with the opposite end of each elongated member including a said cooling fluid outlet.

8. The frame of claim 7 wherein each said cooling fluid outlet includes an orifice arranged at each said opposite end.

9. The frame of claim 1 wherein said means for connecting a source of electrical power further comprises:

i) an electrical connection adapted to connect to a source of electrical power, said electrical connection mounted on said base structure; and ii) electrical wiring extending from said electrical connection and through at least a portion of said first passageway to an electrical wiring outlet mounted on said base structure, said electrical wiring for connection to electrically powered components of said molten metal pump.

10. The frame of claim 9 wherein said cooling fluid inlet includes a first means for coupling to said source of cooling fluid and said another cooling fluid outlet includes a second means for coupling to a component of said molten metal pump.

11. The frame of claim 10 wherein said first and second means for coupling include flexible hose.

12. The frame of claim 11 wherein said molten metal pump supporting structure further comprises a pair of spaced apart elongated members, one end of each elongated member attached to said base frame with the opposite end of each elongated member including said cooling fluid outlet.

13. In a method of supporting a molten metal pump over an open surfaced molten metal bath on a molten metal pump frame and pumping molten metal in said bath, the improvement comprising the steps of:

a) providing a source of cooling fluid;

b) providing a molten metal pump frame having a base structure for supporting said molten metal pump frame and a molten metal pump supporting structure integrally attached to said base structure, wherein said base frame and said molten metal pump supporting structure are sized to form a portable molten metal pump frame to facilitate positioning over a molten metal bath, said molten metal pump frame including a passageway therethrough;

c) flowing said cooling fluid through said passageway to cool said molten metal pump frame during said pumping of molten metal; and d) providing said molten metal pump frame with another passageway and flowing said cooling fluid to said molten metal pump through said another passageway for cooling of molten metal pump components.

14. The method of claim 13 further comprising the step of providing a means for electrically connecting said molten pump to a source of electrical power, said means for electrically connecting associated with said base structure.

* * * * *